US008061190B2

(12) United States Patent
Mezger et al.

(10) Patent No.: US 8,061,190 B2
(45) Date of Patent: Nov. 22, 2011

(54) METHOD FOR OPERATING AN INTERNAL COMBUSTION ENGINE

(75) Inventors: Werner Mezger, Eberstadt (DE); Matthias Entenmann, Bietigheim-Bissingen (DE); Georg Geywitz, Ittlingen (DE); Dragan Mikulec, Landshut (DE)

(73) Assignee: Robert Bosch GmbH, Stuttgart (DE)

( * ) Notice: Subject to any disclaimer, the term of this patent is extended or adjusted under 35 U.S.C. 154(b) by 272 days.

(21) Appl. No.: 12/090,527

(22) PCT Filed: Nov. 13, 2006

(86) PCT No.: PCT/EP2006/068390
§ 371 (c)(1),
(2), (4) Date: Sep. 15, 2008

(87) PCT Pub. No.: WO2007/068543
PCT Pub. Date: Jun. 21, 2007

(65) Prior Publication Data

US 2009/0120402 A1 May 14, 2009

(30) Foreign Application Priority Data

Dec. 14, 2005 (DE) ..... 10 2005 059 575

(51) Int. Cl.
*G01M 15/08* (2006.01)

(52) U.S. Cl. ..... 73/114.79

(58) Field of Classification Search ..... 73/114.79; 123/90.15, 90.17
See application file for complete search history.

(56) References Cited

U.S. PATENT DOCUMENTS

| | | | | |
|---|---|---|---|---|
| 5,056,477 | A | 10/1991 | Linder et al. | |
| 5,417,187 | A * | 5/1995 | Meyer et al. | 123/90.17 |
| 5,899,181 | A * | 5/1999 | Kurata et al. | 123/90.17 |
| 5,905,193 | A * | 5/1999 | Hashizume et al. | 73/35.09 |
| 5,912,821 | A * | 6/1999 | Kobayashi | 700/280 |
| 6,311,655 | B1 | 11/2001 | Simpson et al. | |
| 6,357,404 | B1 * | 3/2002 | Deeg | 123/90.15 |
| 6,408,685 | B2 * | 6/2002 | Shin | 73/114.01 |
| 6,561,146 | B2 * | 5/2003 | Todd et al. | 123/90.15 |
| 6,666,181 | B2 * | 12/2003 | Smith et al. | 123/90.17 |
| 7,004,126 | B2 * | 2/2006 | Nagano et al. | 123/90.15 |
| 7,214,153 | B2 * | 5/2007 | Simpson | 474/101 |
| 7,222,593 | B2 * | 5/2007 | Stork et al. | 123/90.15 |
| 7,467,042 | B2 * | 12/2008 | Sikora et al. | 701/114 |
| 2003/0019447 | A1 * | 1/2003 | Todd et al. | 123/90.15 |
| 2003/0196626 | A1 * | 10/2003 | Smith et al. | 123/90.17 |
| 2005/0014586 | A1 * | 1/2005 | Simpson | 474/101 |

FOREIGN PATENT DOCUMENTS

| | | |
|---|---|---|
| DE | 3930157 | 3/1991 |
| DE | 19741597 | 3/1999 |
| EP | 1103707 | 5/2001 |
| EP | 1279799 | 1/2003 |
| EP | 1355047 | 10/2003 |
| WO | WO 03/102381 | 12/2003 |

OTHER PUBLICATIONS

International Search Report, PCT International Patent Application No. PCT/EP2006/068390, dated Feb. 21, 2007.

* cited by examiner

*Primary Examiner* — Freddie Kirkland, III
(74) *Attorney, Agent, or Firm* — Kenyon & Kenyon LLP

(57) ABSTRACT

Angular adjustment of a camshaft in an internal combustion engine. A vibrational condition of the camshaft is recorded, and an enabling of the camshaft adjustment and/or the use of the instantaneous value of the camshaft position are/is dependent at least temporarily on the recorded vibrational condition.

14 Claims, 4 Drawing Sheets

METHOD FOR OPERATING AN INTERNAL COMBUSTION ENGINE

FIELD OF THE INVENTION

The present invention relates to a method, a computer program, an electrical storage medium, and a control and/or regulating device for operating an internal combustion engine.

BACKGROUND INFORMATION

A method of this type is described in German Patent Application No. DE 39 30 157 A1. It is used for camshafts of internal combustion engines. When such an angular adjustment of a camshaft is employed, the opening and closing angles of an intake or exhaust valve of the internal combustion engine can be adapted to the particular operating situation of the internal combustion engine. In the conventional method, a hydraulic control system is used for angularly adjusting the camshaft position in relation to the crankshaft. To that end, as a function of two hydraulic chambers acting in mutual opposition, the camshaft is linked to a setting element driven by the crankshaft. The position of the camshaft relative to the setting element changes depending on the hydraulic volume that is adjusted in the one or other hydraulic chamber. A hydraulic valve controls the charging of the hydraulic chambers with hydraulic fluid. The hydraulic valve is driven electrically by a control and/or regulating device.

Problems can arise under certain operating conditions of the internal combustion engine when the position of the camshaft is angularly adjusted in relation to the crankshaft. For that reason, such a camshaft adjustment is only enabled by the control and/or regulating device under certain predefined operating conditions of the internal combustion engine. When the angular adjustment has not been enabled, the adjusting element is mechanically and/or hydraulically retained in a defined locking position. The actual angular position of the camshaft is recorded by a sensor and used in the control and/or regulating device for ascertaining the air charge in the cylinder and for ascertaining the ignition angle.

SUMMARY

An object of the present invention is to improve the manner in which the air charge and the ignition angle are determined to such an extent that the internal combustion engine will exhibit a smooth performance that is acceptable to the user in preferably all operating situations.

Camshaft vibrations may occur in certain operating situations of the internal combustion engine. Such operating conditions include, for example, start-up of the internal combustion engine when, initially, the hydraulic pressure is not sufficient to allow a precise adjustment of the camshaft position. In addition, the situation may arise where, at a high temperature of the hydraulic fluid, its viscosity is reduced, leading, in turn, to increased hydraulic leakage.

The hydraulic quantity that is available for angularly adjusting the camshaft no longer suffices then for precisely setting the camshaft. At a low speed or during idling of the internal combustion engine, a positioning controller of the camshaft may experience system deviations in the case of a hot internal combustion engine. To prevent this, the camshaft is typically locked in a defined position in specific operating situations of the internal combustion engine.

At a low hydraulic pressure and/or high hydraulic temperature and/or given a camshaft in the unlocked condition, the camshaft may be subject to heavy vibrations. If what is known as a rotary actuator is used to angularly adjust the camshaft, the situation may even occur in the extreme case where the camshaft oscillates between the mechanical limit stops that are provided. This camshaft excitation results in a heavily pulsating actual angular position of the camshaft. This degrades the process of ascertaining the air charge and the ignition angle in the control and regulating device. These effects are directly perceptible in the performance of the internal combustion engine.

The present invention intervenes here in two ways, both measures having in common that they are dependent on the recorded vibrational condition of the camshaft and not rigidly dependent on any given operating situations of the internal combustion engine: In one case, an enabling of the angular adjustment of the camshaft itself is dependent on the vibrational condition. For example, it is possible to block an enabling of the camshaft adjustment due to operating conditions, thus not to grant the enabling or to at least to delay such an enabling. Moreover, the enabling of the camshaft adjustment may be further delayed when, following start-up of the internal combustion engine, it is ascertained that the vibrational condition of the camshaft is unacceptable.

However, to be able to ensure an optimal operation in terms of emissions, the enabling of the camshaft adjustment may be forced once a maximum time period has elapsed. When the camshaft adjustment is enabled as a function of the vibrational condition, the occurrence of vibrations is minimized, and a stable instantaneous value is consequently available for determining the air charge and the ignition angle, resulting in a smoother performance of the internal combustion engine.

However, the use of the instantaneous value of the camshaft position may also be made to be dependent upon the recorded vibrational condition. For example, if the vibrational condition is unacceptable, the instantaneous value may be filtered prior to its use.

For the first time period, from the start of the internal combustion engine and/or for the subsequent second time period up until the camshaft adjustment is enabled, in the context of an acceptable and unacceptable vibrational condition, a substitute value that preferably corresponds to the locking position may be additionally used in place of the actual and unfiltered instantaneous value. In the case that a camshaft continues to be subject to heavy vibrational load, an air charge and the ignition angle are then no longer ascertained using the actual instantaneous value of the camshaft position, but rather using a substitute value or a filtered instantaneous value. Such a filtered instantaneous value clearly pulsates to a lesser degree, resulting in an improved determination of the air charge and of the ignition angle. Here as well, the result is an improved internal combustion engine performance, most notably, a better starting and idling quality and an enhanced combustion stability.

To filter the instantaneous value, it is especially advantageous for a filter time constant to be used that is dependent on the current operating situation of the internal combustion engine. Thus, the filter time constant may include a first speed-dependent component, for example, which describes the ground noise in the drivetrain, and a second component that is dependent on the oscillation frequency and/or on the oscillation amplitude of the unfiltered instantaneous value of the camshaft position and/or on the filtered instantaneous value of the camshaft. In this context, the filter time constant is all the greater, the greater the degree (in terms of amplitude) of oscillation of the unfiltered instantaneous value of the camshaft position. In the case that the filtered instantaneous value oscillates excessively due to the evaluation, the filter time constant may be increased further.

If the vibrational condition is again acceptable, an unfiltered instantaneous value is again used, for example, to ascertain the air charge of the cylinder and the ignition angle. Thus, in all operating ranges of the internal combustion engine, the vibrational condition of the camshaft is recorded, and an instantaneous value that is optimal for operating the internal combustion engine is used.

An unacceptable vibrational condition may be recognized in a simple manner by analyzing an oscillation frequency and/or an oscillation amplitude of the unfiltered instantaneous value of the camshaft position. In addition, once the camshaft adjustment has been enabled, the system deviation of a positioning controller of the camshaft may also be analyzed in order to recognize an unacceptable vibrational condition.

BRIEF DESCRIPTION OF THE DRAWINGS

An especially preferred exemplary embodiment of the present invention is described in greater detail below with reference to the figures.

FIG. 3' shows a flow chart of a subprocess of the process of FIG. 3.

DETAILED DESCRIPTION OF EXAMPLE EMBODIMENTS

Figure 1:
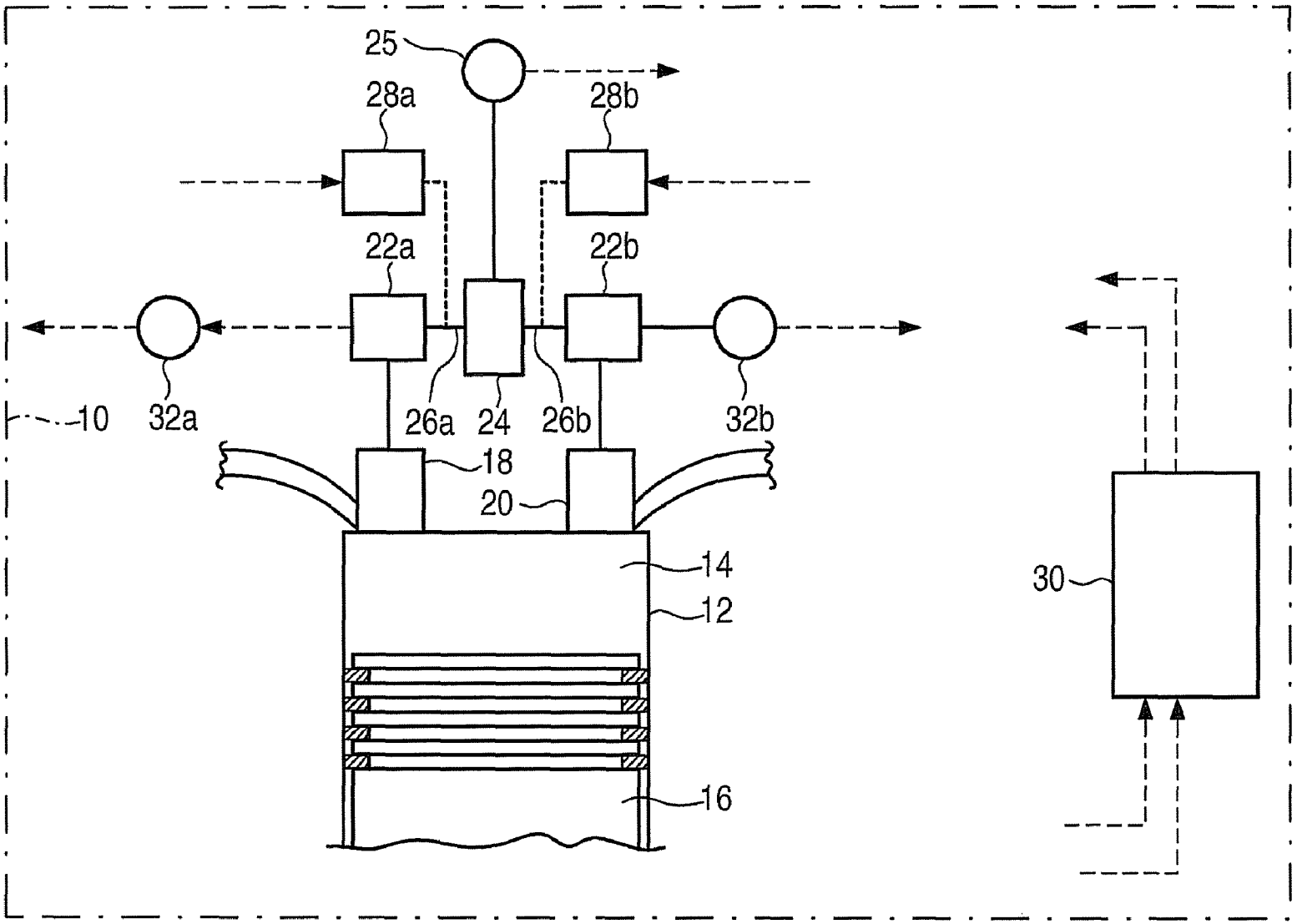
FIG. 1 shows a schematic representation of an internal combustion engine.

In FIG. 1, an internal combustion engine is denoted as a whole by reference numeral 10. For the sake of simplicity, it is represented only very schematically by a dot-dash line. It is used for driving a motor vehicle, for example.

Internal combustion engine 10 includes a plurality of cylinders, of which only one denoted by reference numeral 12 is shown in FIG. 1. Provided therein is a combustion chamber 14 that is bounded by a piston 16. Air may be supplied via an intake valve 18 to combustion chamber 14; hot burned combustion gases are evacuated via an exhaust valve 20 from combustion chamber 14. Intake valve 18 and exhaust valve 20 are actuated by a camshaft 22*a* and 22*b*, respectively, which are driven by a crankshaft 24 of internal combustion engine 20, whose speed is recorded by a sensor 25. For this, camshafts 22*a* and 22*b* are linked by corresponding coupling devices 26*a* and 26*b* to crankshaft 24.

At this point, the following is noted: Some similar elements are denoted in the following by the same reference numerals, but are labeled with different alphabetical indices. If the alphabetical indices are not used, the variants of the elements apply as such.

To be able to operate the internal combustion engine optimally in terms of consumption and emissions, the positions of camshafts 22*a* and 22*b* in relation to crankshaft 24 are angularly adjusted to a certain degree. Thus, the coupling is settable by coupling device 26. To this end, hydraulic camshaft actuators 28*a* and 28*b* are used which are driven by a control and regulating device 30. The current position of camshafts 22*a* and 22*b* is recorded by sensors 32*a* and 32*b* which make the corresponding signals available to control and regulating device 30.

Figure 2:
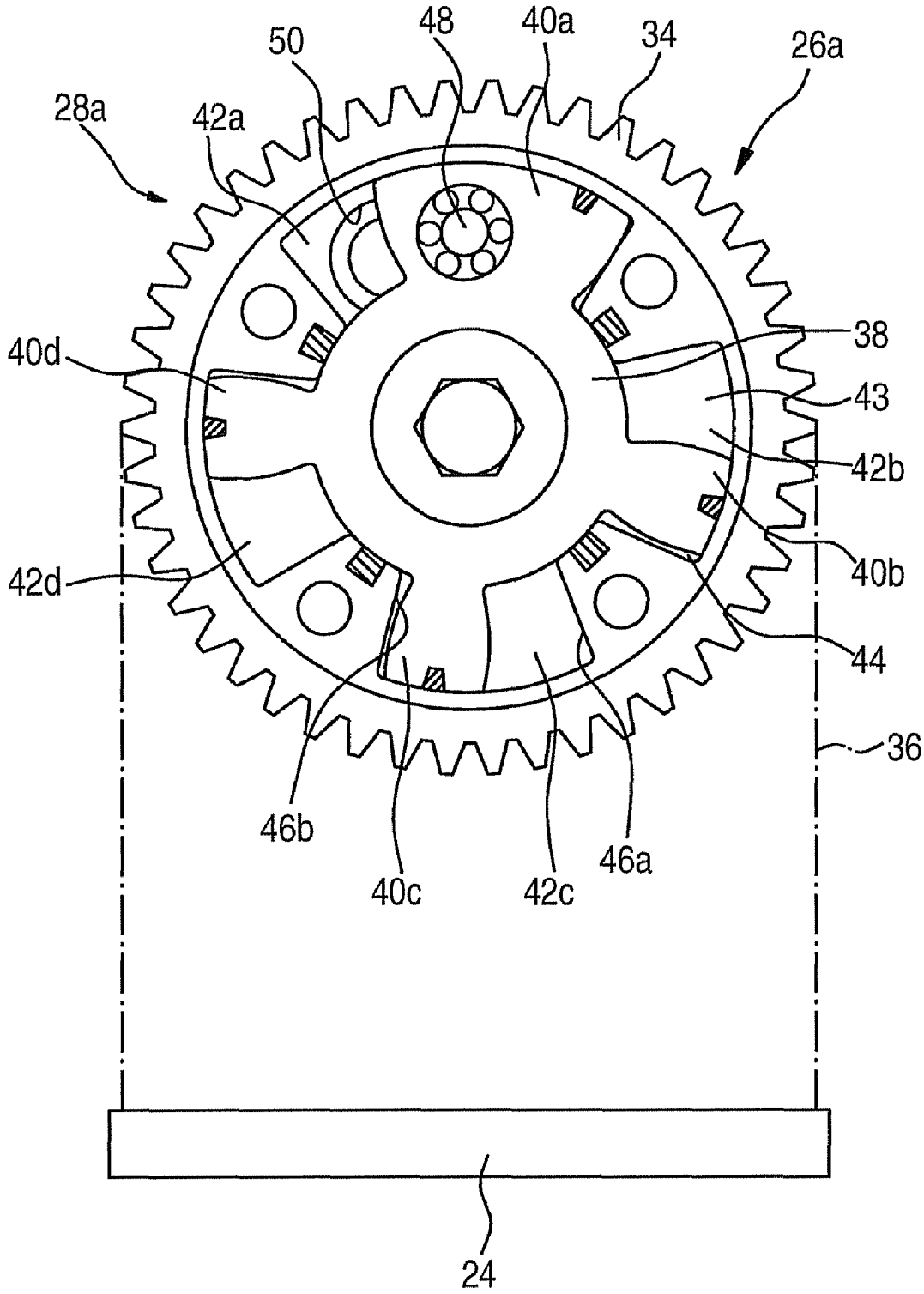
FIG. 2 shows a schematic representation of a device for hydraulically angularly adjusting a camshaft of the internal combustion engine of FIG. 1.

Coupling device 26*a* and camshaft actuator 28 designed as a rotary actuator 28*a* are shown in greater detail in FIG. 2. To this end, corresponding elements 26*b* and 28*b* are identical. Camshaft actuator 28*a* includes a stator frame 34 that is linked via a tooth-type chain 36 to crankshaft 24. Disposed coaxially to stator frame 34 inside of the same is a rotor 38 which engages by four vanes 40*a* through 40*d* into corresponding cutouts 42*a* through 42*d* of stator frame 34. A hydraulic chamber is formed in this manner on each side of a vane 40, viewed circumferentially. These hydraulic chambers are only provided with reference numerals, namely with 43 and 44, for vane 40*b*.

The position of rotor 38 in relation to stator housing 34 varies as a function of the pressurization of first hydraulic chambers 43 and of second hydraulic chambers 44. This also changes the position of camshaft 22*a* in relation to crankshaft 24 since rotor 38 is rigidly connected to camshaft 22*a*. The angular adjustment range is formed by the respective radial bounds of cut-outs 42*a* through 42*d* which are provided with reference numerals, namely with 46*a* and 46*b*, only for cut-out 42*c*. Limit stops 46*a* and 46*b* are hereby formed for vanes 40*a* through 41*d*.

Camshaft actuator 28*a* shown in FIG. 2 has a mechanical locking position. It is defined by a locking pin 48 on rotor 38 which, in the locking position, locks into a cut-out 50 on stator frame 34.

Figure 3:
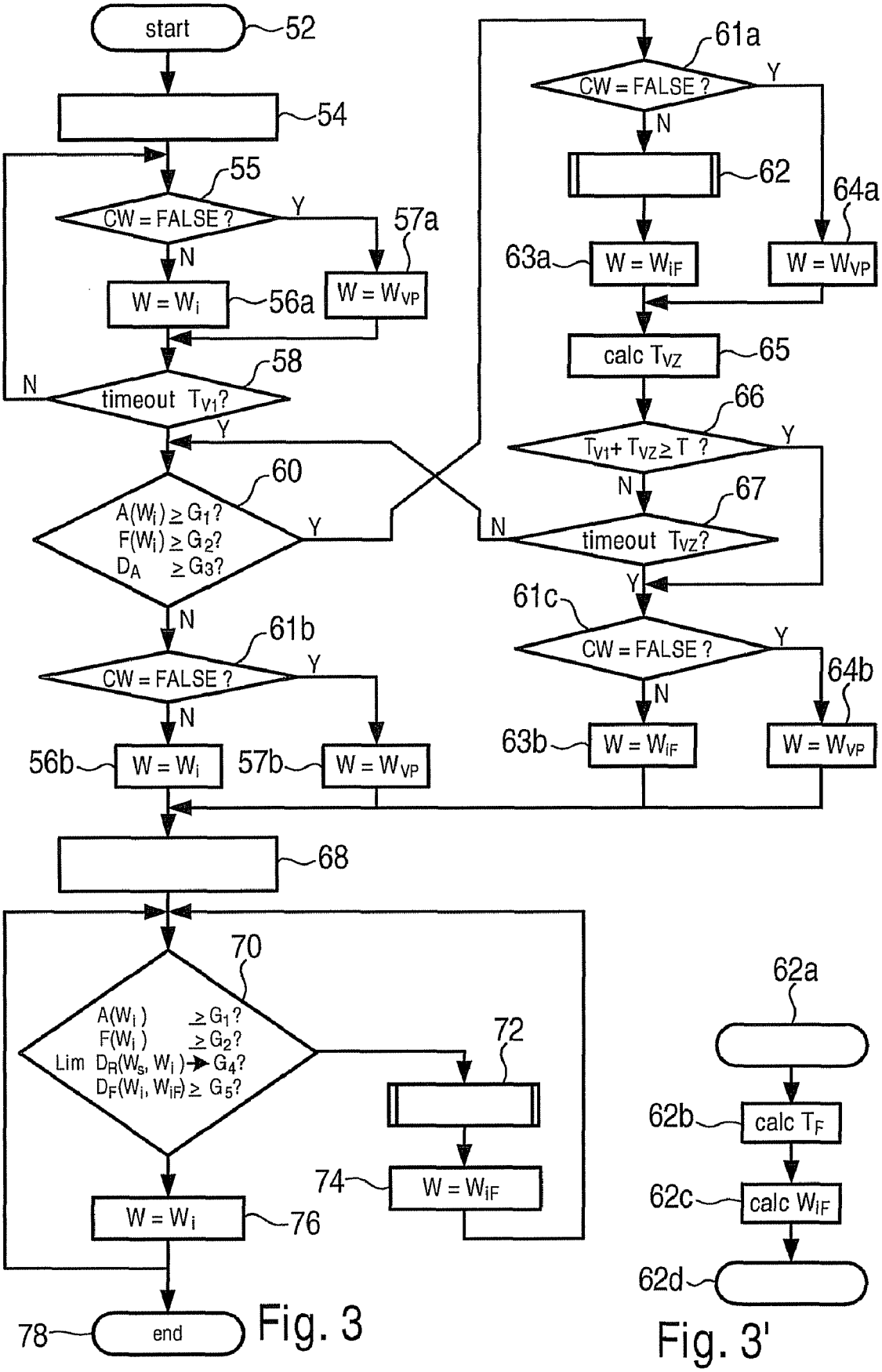
FIG. 3 shows a flow chart of a process for operating the adjusting device of FIG. 2.

A method employed for driving camshaft actuator 28 by control and regulating device 30 is clarified at this point with reference to FIG. 3. In this context, the method is stored on a memory of control and regulating device 30 in the form of a computer program. Its objective is to prevent heavy vibrations of camshafts 22*a* and 22*b* relative to crankshaft 24 by delaying an enabling of angular adjustment of camshafts 22*a* and 22*b* as a function of the operating conditions (since the following explanations apply equally to both camshafts 22*a* and 22*b*, for the sake of simplicity, only camshaft 22 is generally discussed in the following). If it is not possible to prevent these vibrations, they should at least be minimized by additionally delaying the enabling of angular adjustment of camshaft 22 as a function of the vibrational condition of camshaft 22, and/or the influence thereof on the determination of the air volume arriving in combustion chamber 14 and an ignition angle should be reduced.

Subsequently to the starting of internal combustion engine 10 in block 52, an "anti-jitter algorithm" is initialized and activated in a block 54. This is described in greater detail further on. Since it is at least initially assumed in control and regulating device 30 that camshaft 22 is in the locking position, a selection is made in a block 55 as a function of a code word CW as to whether a calculation of an air charge of combustion chamber 14 and of an ignition angle is performed using a fixed value $W_{VP}$ for the position of camshaft 22 in relation to crankshaft 24, which corresponds to the locking position (block 57), or using actual instantaneous value $W_i$ of the camshaft (block 56).

It is checked in a block 58 whether a first time period $T_{V1}$ has elapsed. If it has not yet elapsed, an enabling of an angular adjustment of camshaft 22 is delayed by this first time period $T_{V1}$. Therefore, time period $T_{V1}$ is also termed "delay time." It is predefined and begins at start-up of internal combustion engine 10 in block 52.

In a block 60, a first aspect of the anti-jitter algorithm comes into play: It is observed or recorded in this block whether the current vibrational condition of camshaft 22 is unacceptable. This is the case, for example, when an oscillation frequency F and/or an oscillation amplitude A of the position of camshaft 22 in relation to crankshaft 24 (camshaft position) have/has reached or exceeded a limiting value.

To assess and detect the oscillations of camshaft 22, actual angular position $W_i$ of camshaft 22 is recorded at every sampling instant, and/or frequency F and/or amplitude A thereof are computed and evaluated in a comparison with corresponding limiting values $G_1$ and $G_2$. An evaluation is also carried out in a comparison with a limiting value $G_3$ to determine how large distance $D_A$ is between actual angular position $W_i$ and locking position $W_{VP}$ of camshaft 22. If the response is affirmative in block 60, thus, if an unacceptable vibrational condition exists, then there continues to be a further delay in the enabling of angular adjustment of camshaft 22 until its vibrations have subsided to an acceptable level or until a second time period $T_{VZ}$ (additional delay time) has elapsed in block 67, or until a maximum delay time T has been reached or exceeded in block 66.

To this end, a selection is first made in a block 61*a* as a function of a code word CW as to whether a calculation of an air charge of combustion chamber 14 and of an ignition angle is performed using a fixed value $W_{VP}$ (block 64*a*) or using filtered instantaneous value $W_{iF}$ of camshaft 22 (block 63*a*) Filtered instantaneous value $W_{iF}$ is computed in a subroutine in block 62. As is apparent from FIG. 3', the subroutine is started in block 62*a*. In a block 62*b*, filter time constant $T_F$ and, subsequently thereto, in a block 62*c*, filtered instantaneous value $W_{iF}$ are calculated. The return to the main program takes place in a block 62*d*.

In a subsequent block 65, second time period $T_{VZ}$, which follows first time period $T_{V1}$ is computed. This time period $T_{VZ}$ is selected in such a way that, on the basis of various operating parameters of internal combustion engine 10, the vibrations of camshaft 22 ascertained in block 60 die out to an acceptable level.

However, in a block 66, it is monitored whether a maximum allowable delay time T, which is stored as a fixed value, has elapsed or been exceeded. If the response in block 66 is negative, in block 67, the enabling of angular adjustment continues to be further delayed until the expiration of $T_{VZ}$, and a return to before block 60 follows. On the other hand, if the response in block 66 is affirmative, code word CW is verified in 61*c* and, as a function of the response, either filtered instantaneous value $W_{iF}$ is output in 63*b* or fixed value Wvp is output in 64*b*. Subsequently thereto, the enabling of an optional angular adjustment of camshaft 22 is forced in 68. This applies similarly to the case when it is ascertained in block 60 that the vibrations of camshaft 22 are comparatively minor, thus that a reliable vibrational condition exists: In this case, code word CW is again queried in 61*b* and, as a function of the response, either actual instantaneous value $W_i$ is output in 56*b* or fixed value $W_{VP}$ is output in 57*b*. The same also applies to when additional delay time $T_{VZ}$ has elapsed. This is followed by block 68.

Subsequently to the enabling of angular adjustment of camshaft 22 in block 68, it is assumed that camshaft 22 is angularly adjusted in accordance with a specified setpoint value, respectively setpoint angle $W_s$. In the normal case, a positioning controller (not shown in FIG. 3) of camshaft actuator 28 that is realized as an appropriate software module in control and regulating device 30, ensures that instantaneous value $W_i$ of the position of camshaft 22 always follows predefined setpoint value $W_s$ in the dynamic case. In the steady-state case, instantaneous value $W_i$ corresponds qualitatively to setpoint value $W_s$.

In specific cases that do not correspond to the normal case, angular adjustment problems may arise, however, once the enabling of angular adjustment is issued in block 68, either when camshaft 22 is locked in block 68 up until enabling of angular adjustment, and when the enabling of angular adjustment is issued too early in block 68, or when camshaft 22 is not locked, up until enabling of angular adjustment in block 68 and vibrates to an unacceptable degree, and the enabling of angular adjustment in block 68 is not forced following expiration of maximum delay time T (block 66).

In the context of such angular adjustment problems, camshaft 22 may vibrate, for example, in response to too low hydraulic pressure, high oil temperature accompanied by correspondingly low hydraulic viscosity and internal hydraulic leakage. The mentioned factors reduce the positioning power in camshaft actuator 28. Moreover, the positioning controller is not capable of compensating for the difference between instantaneous value $W_i$ and setpoint value $W_s$. To provide for this special case, also following the enabling of angular adjustment 68, camshaft 22 continues to be monitored in a block 70 to determine whether an unacceptable vibrational condition is at hand. In this case as well, actual angular position $W_i$ of the camshaft is again recorded at every sampling instant, and/or frequency F and/or amplitude A thereof are computed and evaluated by comparing the same with limiting values $G_1$ and $G_2$.

In addition, for system deviation $D_R$ of the positioning controller, thus for the difference between setpoint value $W_S$ and instantaneous value $W_i$, the limits are taken into consideration in order to decide whether instantaneous value $W_i$ of the position of camshaft 22 vibrates to an unacceptable degree. In this context, it is analyzed whether the limit of system deviation $D_R$ approaches a limiting value $G_4$ within an observation period during which the setpoint value does not change. Limiting value $G_4$ is typically selected to be virtually zero. Given a camshaft 22 that does not vibrate or that vibrates within a permissible range, following a change in setpoint value $W_s$. that marks the beginning of an observation period, the positioning controller must ensure that system deviation $D_R$ steadily decrease and finally approach limiting value G4 until there is once again a change in setpoint value $W_s$, marking the end of an observation period. If system deviation $D_R$ does not approach limiting value G4 at the end of an observation period, then this is indicative of an unacceptable vibrational condition of camshaft 22.

The analysis of difference $D_F$ between instantaneous value $W_i$ and filtered instantaneous value $W_{iF}$ performed in a comparison with a limiting value $G_5$ may be a further criterion for deciding whether actual instantaneous value $W_i$ of the camshaft position oscillates to an unacceptable degree. This is especially the case when the camshaft only begins to vibrate following the enabling of angular adjustment. In the context of such an observation, it is assumed for the sake of simplicity that the filtered instantaneous value corresponds to an ideal instantaneous value. Difference $D_F$ between such an ideal instantaneous value and the actual instantaneous value is a measure of the vibration.

In the case that an unacceptable vibrational condition of camshaft 22 is recognized in block 70, instantaneous value $W_i$ of the position of camshaft 22 is filtered. To that end, a filter time constant $T_F$ is first ascertained in a block 72 in the form of a subroutine. This is clarified in detail in the following with reference to FIG. 4. A filtered instantaneous value $W_{iF}$ of the position of camshaft 22 is then computed in the same block 72 using calculated filter time constant $T_F$. A switchover then follows in a block 74 in the sense that filtered instantaneous value $W_{iF}$ of the position of camshaft 22 is now used to calculate the air charge in combustion chamber 14 and the ignition angle. Subsequently thereto, a return to before block 70 follows. If, on the other hand, a camshaft 22 that is not vibrating or that is vibrating within the permissible range is recognized in block 70, a switchover then follows in block 76 in the sense that actual, unfiltered instantaneous value $W_i$ of the position of camshaft 22 is used to calculate the air charge in combustion chamber 14 and the ignition angle. The process ends in block 78.

Figure 4:
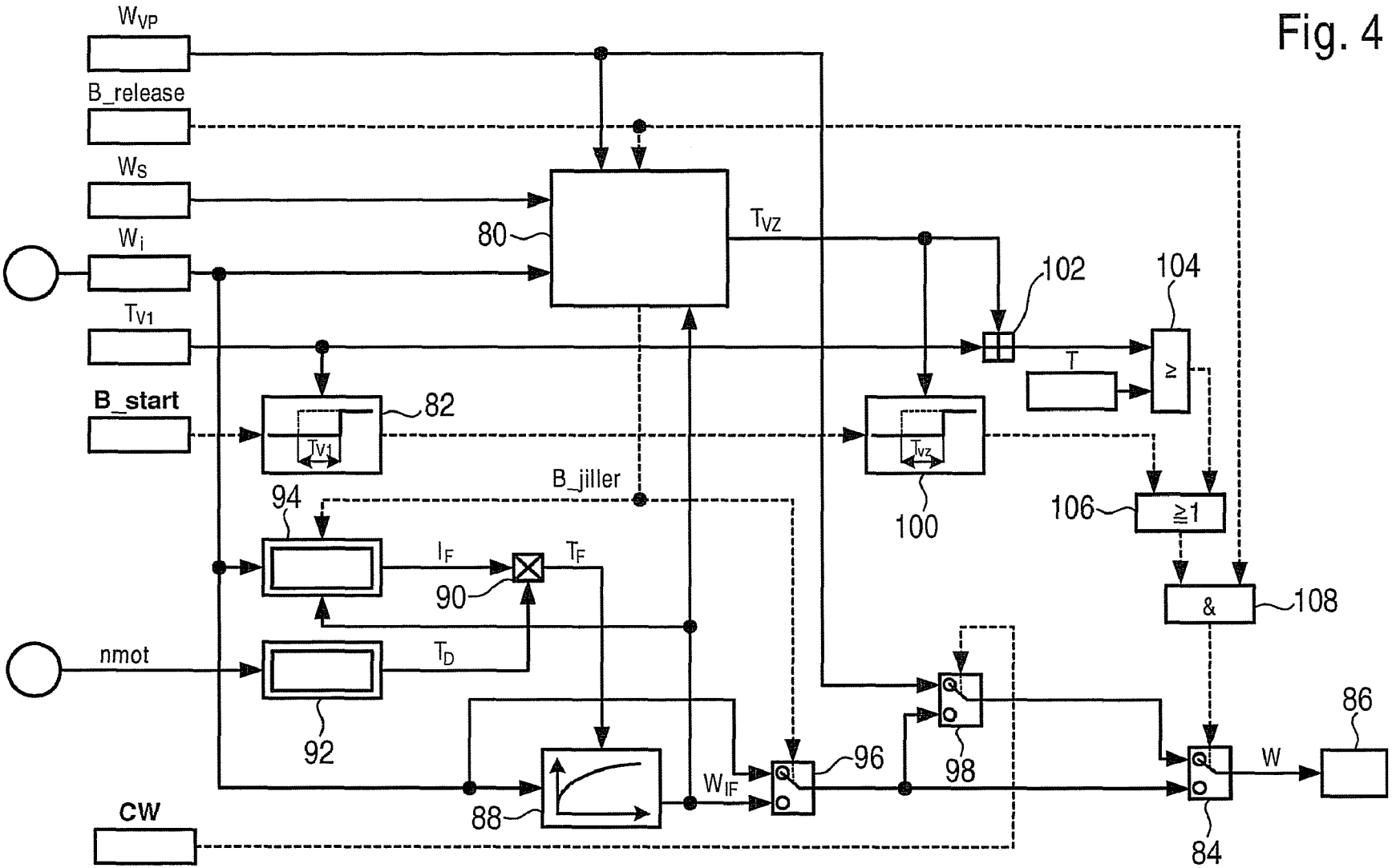
FIG. 4 shows a flow chart showing portions of the process of FIG. 3 in greater detail.

Individual method steps of the method illustrated in FIG. 3 and relationships thereof are shown in FIG. 4: Block 80 is a central decision block: The functions of method blocks 60 through 70 of FIG. 3 are completely or partially combined therein. Block 80 is fed, first of all, the actual enabling of the camshaft adjustment in the form of a bits B_release, value $W_{VP}$ for the locking position, setpoint value $W_s$ for the position of camshaft 22, instantaneous value $W_i$ of the position of camshaft 22 recorded by sensor 32, and finally also filtered instantaneous value $W_{iF}$ for the position of camshaft 22.

As soon as a bit B_start is set at engine start-up, the output of a delay element 82 is set following expiration of delay time $T_{V1}$ and routed to a delay element 100, which leads during delay time $T_{V1}$ to a switch 84 routing the result of a switch 98, a fixed value $W_{VP}$ of the locking position or the result of the switch setting 96 to the calculation of the air charge and of the ignition angle in a block 86. In central decision block 80, it is also checked whether an unacceptable vibrational condition of camshaft 22 is at hand, and, as the case may be, within this block, second time period $T_{VZ}$ (which is greater than zero) is calculated and output to delay element 100. An unacceptable vibrational condition is then indicated by set bit B_jitter.

As long as second time period $T_{VZ}$ has not yet elapsed, delay element 100 is reset, whereby switch 84 is still kept beyond delay time $T_{V1}$ in that switch setting in which either fixed value $W_{VP}$ or the result of switch setting 96 (in the case of an unacceptable vibration condition, this is the filtered actual value) is routed to block 86, in accordance with block 63 or 64 in FIG. 3. Switch 84 is kept in that switch setting by an OR element 106 for only a maximum time T and thus changed over to the new switch setting (the result of switch setting 96) when the result of the comparison yields a true statement in a block 104.

The comparison is made in block 104 to determine whether the sum of the two time periods $T_{V1}$ and $T_{VZ}$ in block 102 is greater than or equal to a maximum time T. In the case that time periods $T_{V1}$ and/or $T_{VZ}$ equal zero, switch 84 is then switched over to the new switch setting (the result of switch setting 96) immediately following the setting of bit B_release. Alternatively, on the basis of an AND element 108, the switchover to the new switch setting continues to be delayed until the result of the comparison in block 104 yields a true statement.

FIG. 4 shows that filtered instantaneous value $W_{iF}$ for the position of camshaft 22 is effected by a filter 88 which is supplied with instantaneous value $W_i$ for the position of camshaft 22 and addressed by a variable filter time constant $T_F$. The latter is calculated in 90 by multiplying a component $I_F$ by a component $T_d$. Component $T_d$ is generated in a functional block 92 into which is fed speed nmot of crankshaft 24 of internal combustion engine 10 recorded by sensor 25. Component $T_d$ describes the ground noise in a drivetrain of internal combustion engine 10.

Component $I_F$, in turn, is generated in a computational block 94, into which are fed unfiltered actual value $W_i$ and filtered actual value $W_{iF}$ of the camshaft position, as well as, from decision block 80, a bit B_jitter for signaling an unacceptable vibrational condition of camshaft 22. In block 94, at every sampling instant, actual angular position $W_i$ of camshaft 22 is recorded, and frequency F and/or amplitude A thereof are computed, and factor $I_F$ is determined, in turn, as a function thereof.

If necessary, factor $I_F$ is corrected to larger, respectively to smaller values by subsequently feeding back filtered instantaneous value $W_{iF}$. In this context, filter time constant $T_F$ is greater, the greater the degree of oscillation of actual instantaneous value $W_i$ of the position of camshaft 22. In the case that bit B_jitter is not set or is reset in decision block 80 because there is no or there is an acceptable vibrational condition of camshaft 22, block 94 is or will then be deactivated and factor $I_F$ corresponds to the value one.

If it is ascertained in central decision block 80 that there are no vibrations or only slight vibrations of camshaft 22 at hand, a switch 96 is then driven accordingly (reset bit B_jitter) in order to route unfiltered instantaneous value $W_i$ of the position of camshaft 22 to switch 84 and 98. Alternatively, switch 96 is driven (set bit B_jitter) in such a way that filtered instantaneous value $W_{iF}$ is retransmitted.

What is claimed is:

1. A method for operating an internal combustion engine, the method comprising:

recording a vibrational condition of a camshaft; and performing at least one of the following: (i) enabling an angular adjustment of the camshaft depending on the recorded vibrational condition, and (ii) using a filtered value or an unfiltered value of an instantaneous value of a camshaft position depending on the recorded vibrational condition.

2. The method as recited in claim 1, wherein, when the vibrational condition is one predefined as being unacceptable, a filtered instantaneous value or a fixed value is used.

3. The method as recited in claim 2, wherein a filter time constant is dependent on a speed of a crankshaft of the internal combustion engine.

4. The method as recited in claim 2, wherein a filter time constant is dependent on at least one of an oscillation frequency and an oscillation amplitude of the unfiltered instantaneous value of the camshaft position.

5. The method as recited in claim 2, wherein a filter time constant is dependent on a filtered instantaneous value of the camshaft position.

6. The method as recited in claim 2, wherein, when the vibrational condition is again one predefined as being acceptable, an unfiltered instantaneous value is again used.

7. The method as recited in claim 1, wherein, within a first time period following a start-up of the internal combustion engine, an enabling of the camshaft adjustment is not issued until an end of the first time period.

8. The method as recited in claim 7, wherein, when the vibrational condition is one predefined as being unacceptable, an enabling of the camshaft adjustment is not issued, at the longest, until an end of a second time period following the first time period.

9. The method as recited in claim 8, wherein, during the first time period or the second time period when the vibrational condition is one predefined as being unacceptable, a filtered instantaneous value or a fixed value is used, and, when the vibrational condition is one predefined as being acceptable, an unfiltered instantaneous value or a fixed value is used.

10. The method as recited in claim 8, the enabling is forced when a predefined maximum period of time has elapsed since the start-up of the internal combustion engine.

11. The method as recited in claim 1, wherein at least one of an oscillation frequency and/or an oscillation amplitude of the unfiltered instantaneous value of the camshaft position, a system deviation of a positioning controller of the camshaft, and a difference between the filtered actual angular position and the unfiltered actual angular position are analyzed in order to recognize a vibrational condition predefined as unacceptable.

12. A non-transitory storage medium storing a computer program, the computer program being executable by a control device, comprising:

a program code arrangement having program code for performing the following:

recording a vibrational condition of a camshaft; and performing at least one of the following: (i) enabling an angular adjustment of the camshaft depending on the recorded vibrational condition, and (ii) using a filtered value or an unfiltered value of an instantaneous value of a camshaft position depending on the recorded vibrational condition.

13. An electrical non-transitory storage medium for a control device of an internal combustion engine, the electrical storage medium storing a computer program, which is executable by the control device, comprising:

a program code arrangement having program code for performing the following:

recording a vibrational condition of a camshaft; and performing at least one of the following: (i) enabling an angular adjustment of the camshaft depending on the recorded vibrational condition, and (ii) using a filtered value or an unfiltered value of an instantaneous value of a camshaft position depending on the recorded vibrational condition.

14. A control device for an internal combustion engine, comprising:

a control arrangement for performing the following:

recording a vibrational condition of a camshaft; and performing at least one of the following: (i) enabling an angular adjustment of the camshaft depending on the recorded vibrational condition, and (ii) using a filtered value or an unfiltered value of an instantaneous value of a camshaft position depending on the recorded vibrational condition.

* * * * *